US007270779B2

(12) United States Patent
Zikeli et al.

(10) Patent No.: US 7,270,779 B2
(45) Date of Patent: Sep. 18, 2007

(54) METHOD AND DEVICE FOR PRODUCING CONTINUOUS MOLDED BODIES

(75) Inventors: Stefan Zikeli, Regau (AT); Friedrich Ecker, Timelkam (AT)

(73) Assignee: Zimmer A.G., Frankfurt am Main (DE)

( * ) Notice: Subject to any disclaimer, the term of this patent is extended or adjusted under 35 U.S.C. 154(b) by 495 days.

(21) Appl. No.: 10/343,492

(22) PCT Filed: Apr. 25, 2001

(86) PCT No.: PCT/EP01/04688

§ 371 (c)(1),
(2), (4) Date: Aug. 11, 2003

(87) PCT Pub. No.: WO02/12599

PCT Pub. Date: Feb. 14, 2002

(65) Prior Publication Data

US 2004/0051202 A1 Mar. 18, 2004

(30) Foreign Application Priority Data

Aug. 3, 2000 (DE) ..... 100 37 923

(51) Int. Cl.

| | |
|---|---|
| ***B29C 47/88*** | (2006.01) |
| ***B29C 47/34*** | (2006.01) |
| ***B29C 55/00*** | (2006.01) |
| ***B28B 5/00*** | (2006.01) |
| ***B28B 1/29*** | (2006.01) |

(52) U.S. Cl. ..... 264/187; 264/211.12; 264/211.14; 264/211.16; 264/203; 425/66; 425/71; 425/464

(58) Field of Classification Search ..... 264/187, 264/211.12, 211.14, 211.16, 203; 425/71, 425/66, 464

See application file for complete search history.

(56) References Cited

U.S. PATENT DOCUMENTS

| | | | | |
|---|---|---|---|---|
| 4,869,860 | A | 9/1989 | Lewis | |
| 5,589,125 | A | 12/1996 | Zikeli et al. | |
| 6,221,487 | B1 | 4/2001 | Luo et al. | |
| 6,706,224 | B2 * | 3/2004 | Firgo et al. | 264/103 |

FOREIGN PATENT DOCUMENTS

| | | |
|---|---|---|
| DE | 29 20 676 | 11/1979 |
| TW | 324749 | 12/1996 |

OTHER PUBLICATIONS

Patent Abstracts of Japan, vol. 9, No. 96, published Apr. 25, 1985.
English Translation of Office Action issued in Taiwanese Application No. 90118940, no date.

* cited by examiner

*Primary Examiner*—Stephen J. Lechert, Jr.
(74) *Attorney, Agent, or Firm*—McDonnell Boehnen Hulbert & Berghoff LLP

(57) ABSTRACT

The present invention relates to a method and an apparatus for extruding continuously molded bodies, wherein an extrusion solution, in particular an extrusion solution containing water, cellulose and a tertiary amine oxide, is extruded through an extrusion orifice into a continuously molded body and is then deflected by means of a deflector (7). To improve the quality of the continuously molded bodies produced by the method or apparatus of the invention, the extrusion orifices are arranged in a row such that the individual, continuously molded bodies exit in the form of a curtain (3) form the extrusion head. This curtain is then deflected by the deflector.

20 Claims, 2 Drawing Sheets

METHOD AND DEVICE FOR PRODUCING CONTINUOUS MOLDED BODIES

The present invention relates to a method for extruding continuously molded bodies from an extrusion solution, in particular an extrusion solution containing water, cellulose, and tertiary amine oxide, the method comprising the following steps: supplying the extrusion solution to a plurality of extrusion orifices substantially arranged in a row; extruding the extrusion solution through a respective extrusion orifice to obtain a continuously molded body; and deflecting the continuously molded body by at least one deflector.

The present invention also relates to an apparatus for producing continuously molded bodies from an extrusion solution, in particular from an extrusion solution containing water, cellulose and tertiary amine oxide, the apparatus comprising an extrusion head including a multitude of extrusion orifices substantially arranged in row-like configuration, the extrusion solution during operation being extrudable through the respective extrusion orifices to obtain a continuously molded body, and a deflector by which the extruded, continuously molded bodies are deflected during operation.

A continuously molded body is understood in the following text as a body produced from the extrusion solution in the form of a fiber, a staple fiber, a film or a filament. The extrusion solution is a solution which, in most cases, may be spun and which, apart from a dissolved polymer such as cellulose, contains water and a tertiary amine oxide such as N-methylmorpholine N-oxide.

The initially described method and the above-mentioned apparatus for carrying out said method are known in the prior art, e.g. for fiber production in the textile industry. For the production of a spun fiber the extrusion solution is spun at the extrusion orifices into a respective filament by the extrusion solution being pressed through the extrusion orifices, whereby it is extruded.

To make the generic method more profitable, a plurality of extrusion orifices are combined at one spinning location or one extrusion head or nozzle, so that a multitude of continuously molded bodies, e.g. in the form of filaments, can be spun or extruded at the same time.

The continuously molded bodies from the multitude of extrusion orifices are combined and bundled by a deflector in the conventional methods and apparatuses. Since the stations for aftertreating the continuously molded bodies are normally not positioned in the direction of extrusion, the continuously molded bodies are deflected by the deflector to be subjected to further aftertreating steps, such as washing, pressing, drying.

The profitability of the method is essentially determined by the number and density of the extrusion orifices. However, at an excessively high density of extrusion orifices, also called "hole density", neighboring extrusion orifices affect one another, and the continuously molded bodies tend to stick together. At an excessively high hole density, the heat exchange of the individual, continuously molded bodies is also affected, resulting in a poor quality of the continuously molded bodies produced.

In the prior art the polymer jet exiting from the nozzle is strongly deflected at the nozzle exit edge in the case of a large bundling or converging angle because of the point-like convergence of the continuously molded bodies, resulting in an impairment of the extrusion and spinning operation. Since the bundling angle increases with an increasing nozzle size, the size of the nozzles is limited.

In particular in a method or apparatus in which the continuously molded bodies are immersed into a spin or precipitation bath after extrusion, the large bundling angles have a disadvantageous effect: The large bundling angles affect flow processes and the bath displacement in the bundle of extrusion bodies; at large bundling angles increased turbulences and backflows are observed in the spin bath.

WO 96/20300 discusses these problems by indicating an equation for the maximally admissible bundling angle for a spinning system with a ring nozzle and a point-like deflector in the spin bath. However, at large diameters of the nozzle this equation results in excessively large immersion depths. In addition, the large immersion depths have a negative effect on operability; moreover the frictional forces increase between bundle of filaments and spin bath and at the deflection point of the deflector.

A further problem arising in the design according to WO 96/20300 is the difficult exchange of spin bath liquor in the bundle of filaments. A multitude of filament rows are needed for an economic design of an individual spin position of such a type with ring nozzles. A point-like deflection results in a filament cone whose spin bath volume must constantly be exchanged for preventing excessively great differences in concentration. On account of the ring-like shape it is not only the spin bath directly surrounding the spun filaments that must be exchanged through the spun filaments, but also the spin bath volume that is enclosed by the filament cone. This leads to increased loads on the individual spun filaments, but also to turbulences that affect the spinning process.

WO 94/28218 illustrates another approach; in this document the bundle of filaments exiting from a rectangular nozzle is guided through a spin bath tank which is provided at its lower end with an exit opening through which the bundle of filaments is bundled at one point and discharged from the spin bath system.

This system is also limited in its profitability because of the necessity that excessively large bundling angles should be avoided. To keep the bundling angle small, great immersion depths are needed in this type of design with all of the above-described negative effects. In addition, the great immersion depth results in a high spin-bath exit speed at the exit opening located at the bottom. This high spin-bath exit speed affects the spinning process in the initial spinning operation and also during operation because of the turbulences arising. The high bath exit speed may affect the processing of the filaments in that separate filaments are entrained by the high bath exit speed and are not deflected in a stretched state at the deflection point below the spin bath exit, but flex downwards. Moreover, at an increased filament number per spinning location, a larger exit opening is also needed. Thus, large amounts of spin bath must be circulated that create turbulences in addition.

The spin bath tanks illustrated in WO 94/28218 and WO 96/20300 also affect the initial spinning operation and handling at the spinning locations quite considerably in combination with the necessary large immersion depths.

To permit the manipulation of the spun filament bundle, as required during initial spinning, along the immersion path by the hand of an operator despite the limited arm length of said operator, high constructional efforts are needed. As stated in the cited patent specifications, the necessary access is provided either by openings (doors) (in WO 94/28218) or by additional lifting devices for lifting and lowering the spin bath tank (in WO 96/20300).

It is therefore the object of the present invention to improve the quality of the continuously molded bodies without any losses in the profitability of the method or the apparatus and without any additional constructional efforts or costs, as well as to improve the flow characteristics in the area between the extrusion orifice and the deflector.

According to the invention this object is achieved for the above-mentioned method by the following steps: forming a substantially planar curtain by the individual, continuously molded bodies; and deflecting the curtain by the deflector.

For the above-mentioned apparatus this object is achieved by the measures that the continuously molded bodies form a curtain because of the arrangement of the extrusion orifices, and the continuously molded bodies are deflected by the deflector in the form of a curtain.

These solutions are simple and result in improved flow characteristics in the area between the extrusion orifice and the deflector. In contrast to the prior art, the continuously molded bodies are not already converged at the deflector in a substantially point-like form, but are deflected as a curtain. A curtain in this context means a wide-spread, substantially planar arrangement of substantially adjacently located, continuously molded bodies.

As a result of the deflection as a still wide-spread curtain and not as a bundle of fibers, the angles at which the continuously molded bodies are converged are decreased. This results in a more uniform quality in the continuously molded bodies. Since the angles at which the individual, continuously molded bodies are united as a curtain, no longer vary as much as in the prior art, the flow conditions between the extrusion orifice and the deflector are also simplified.

The spinning quality is improved by the measures that according to the invention the extrusion orifices are arranged in a row and the continuously molded bodies exiting from the extrusion orifices form a curtain. As already stated above, it is possible on account of the wide-spread deflection of the bundle of filaments according to the invention, for instance as a curtain, to considerably increase the nozzle length and thus the profitability of a spinning location.

In addition, the immersion depth can be reduced to the degree required for coagulation because of the wide-spread guiding of the filament bundle in the precipitation bath. In summary, the following problems found in spinning systems according to the prior art can thus be solved or minimized by the invention:

- In contrast to a ring nozzle, a rectangular shape of the nozzle does not result in an enclosed spin bath cone that must be displaced in addition.
- The displacing processes by the filament bundle in the spin bath are minimized, whereby turbulences and backflows are avoided.
- The frictional forces between spin bath and filament bundle and thus the frictional forces acting on the deflector are minimized.
- Thanks to the deflection in the spin bath tank the lower exit opening is omitted, thereby preventing the associated negative effects on spinning behavior, turbulences and handling.
- The access which is above all required in the initial spinning process for manipulating the spun filament bundle along the immersion path by hand is considerably simplified owing to the strongly reduced immersion depth.
- The constructional efforts and thus the costs for such a system are considerably reduced.

The formation of a substantially planar curtain is made easier if in an extrusion head the number of the rows of extrusion orifices is considerably smaller than the number of the extrusion orifices in the respective rows.

In a further advantageous development of the method and the apparatus the deflector may be arranged in a precipitation bath into which the extruded, continuously molded bodies are passed. In this arrangement the continuously molded bodies will only be deflected if they have solidified and can be subjected to mechanical loads. It is thereby ensured that the continuously molded bodies are not damaged by the deflection.

On account of the deflection as a curtain the flow conditions in the precipitation bath are considerably improved over the prior art in the apparatus and method according to the invention: The curtain immerses as a substantially planar body into the precipitation bath; the angles of immersion of the continuously molded bodies do not greatly differ from one another. As a result no strong turbulences are observed in the precipitation bath and the surface of the precipitation bath remains calmer than in the prior art, so that the continuously molded bodies are safely guided through the precipitation bath and cannot stick together or tear. On the whole, the spinning stability or reliability is increased.

In the direction of extrusion downstream of the deflector, a collector may be provided in a further advantageous development for converging the continuously molded bodies substantially at one point and then for passing the same onwards as a bundle, e.g. as a bundle of fibers, to subsequent process steps.

In an advantageous development the method and apparatus according to the invention may comprise an air gap which extends from the extrusion orifice to the precipitation bath.

In this air gap a stretching operation may be carried out, for instance blowing air around the continuously molded bodies in the direction of extrusion. The stretching operation may also be carried out in such a way that the continuously molded bodies are removed by a take-off unit at a take-off speed higher than the extrusion speed.

In the air gap, a blowing operation can also be performed in a direction transverse to the direction of extrusion so as to dry the continuously molded bodies immediately after extrusion. The method and apparatus of the invention can operate with or without a blowing action.

Finally, in a further advantageous development, the spinning system may be of a modular type: By the extrusion orifices of a single extrusion head, individual curtains which are processed jointly are formed. Thus, to increase the production capacity of an existing apparatus, only further extrusion heads or curtains have to be added. This possibility of extension is facilitated according to the invention by arranging the extrusion orifices of one extrusion head substantially in arrow. For an increase of the production capacity, the extrusion heads may be arranged in series, i.e. one after the other, or in parallel, so that additional extrusion heads must just be connected to the existing row of extrusion heads or added in parallel to the already existing extrusion heads. To this end, receiving means are provided in which additional extrusion heads can be detachably inserted or removed in a reinsertable manner.

A particularly easy adaptation of the machine capacity is achieved if at least one extrusion head and at least one deflector are combined in an extension unit. With this design the unit must only be attached to the existing system for increasing the capacity.

The method and apparatus of the invention shall now be explained in more detail with the help of two embodiments with reference to the drawings, in which:

First of all, the structure of the first embodiment is described with reference to FIG. 1.

Figure 1:
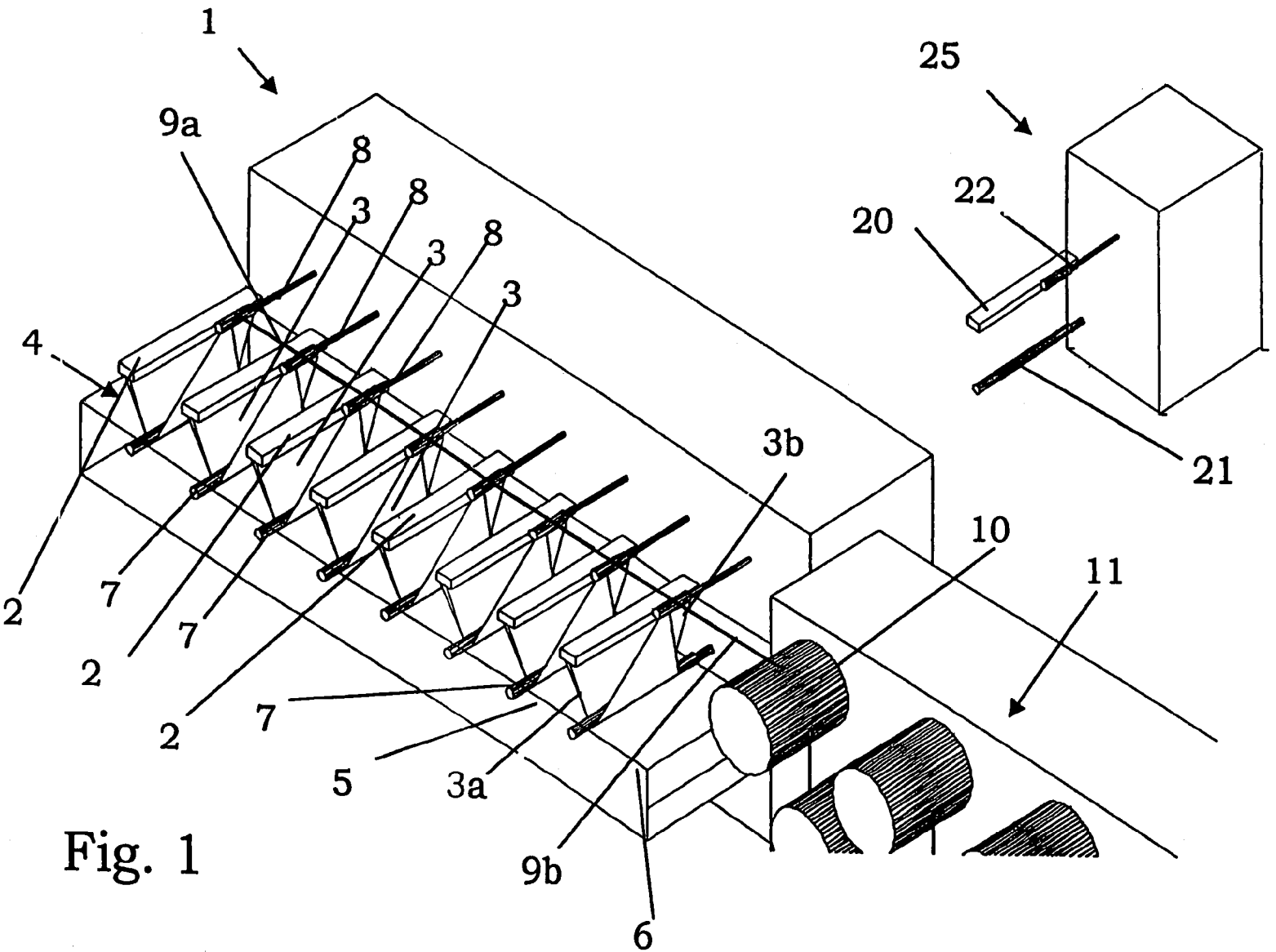
FIG. 1 is a perspective view of a first embodiment of the invention in a schematic representation.

FIG. 1 is a perspective view showing an apparatus 1 for extruding continuously molded bodies; in particular, FIG. 1 shows a spinning machine in which the continuously molded bodies are spun in the form of individual fibers.

To this end, a spinning solution consisting of water, cellulose and tertiary amine oxide is prepared in a supply tank (not shown) and supplied to the spinning system 1 from said supply tank via a pipe or line system (not shown).

Since the spinning solution tends to perform a spontaneous exothermic reaction at high temperatures and long storage times, burst protection devices are provided in the pipe system for discharging the reaction pressure in the case of such a spontaneous exothermic reaction to the outside and for preventing damage to the apparatus 1.

The extrusion solution is conveyed by means of pump systems through the pipe system to the spinning system 1. In the pipe system, there may also be provided a compensating tank (not shown) for compensating pressure and volume variations in the pipe system and for ensuring a uniform and constant feeding of the spinning system 1 with the extrusion solution.

The spinning system 1 is provided with extrusion heads 2 which comprise a multitude of extrusion orifices arranged in rows. In the embodiment of FIG. 1, the number of rows of extrusion orifices is considerably smaller than the number of extrusion orifices in one row. After extrusion through the extrusion orifices, the extrusion solution therefore exits as a substantially planar curtain 3 from the extrusion head 2.

The planar curtain 3 consisting of continuously molded bodies or filaments is directly passed through an air gap 4 after extrusion through the extrusion orifices and then immersed into a precipitation bath 5. In the air gap 4, the continuously molded bodies are stretched.

Deflectors 7 are arranged in the precipitation bath 5 which is held in a tub 6. In the embodiment of FIG. 1 each curtain has assigned thereto a deflector 7. Each of the deflectors 7 extends in the direction of the rows of the extrusion duct orifices. In the spinning system of FIG. 1, the deflectors are designed as cylinders or rollers which rotate with the continuously molded bodies either passively or actively. Alternatively, the deflector 7 may also be designed as a stationary curved surface.

According to the invention, the curtain 3 is not converged by the deflectors 7 at a point, but deflected in the form of a curtain. This has the advantage that the respectively outer, continuously molded bodies 3*a*,3*b* of a curtain immerse into the precipitation bath 5 only at a small angle.

Since the curtain 3 is planar and since the differences in angle between the individual, continuously molded bodies are small, the surface of the precipitation bath 5 stays calm, and no flows are created in the precipitation bath solution that lead to a tearing or sticking together of the individual, continuously molded bodies.

The curtain 3 is guided by the deflector 7 out of the precipitation bath 5 to a collector 8. According to the invention, the curtain is converged towards a point only at the collector 8. From the collector 8, the continuously molded bodies of a curtain are passed on as a bundle of continuously molded bodies or as a fiber bundle.

In the embodiment of FIG. 1, the collectors 8 are also designed as circular cylindrical rollers which are driven by a drive unit or, alternatively, are passively rotated by the movement of the continuously molded bodies, but may also be stationary. Each deflector 7 has assigned thereto a collector 8. The axes of the collectors 8 extend in parallel with the row direction of the extrusion orifices in the extrusion heads 2.

The collectors 8 are arranged one after the other such that the curtains which are converged there to obtain a fiber bundle 9*a* are combined with one another to obtain a joint fiber bundle 9*b*. The fiber bundle 9*b* is drawn off by a take-off mechanism 10.

The take-off mechanism 10 takes off the continuously molded bodies at a predetermined controllable take-off speed that is slightly higher than the extrusion speed of the extrusion solution through the extrusion orifices. On account of this difference in the speeds, a tensile force is applied to the continuously molded bodies and the continuously molded bodies are stretched.

The take-off mechanism 10 may be followed by further processing steps, such as washing, pressing or impregnating. These steps may each be carried out at stations generally designated in FIG. 1 with reference numeral 11.

The spinning system 1 is of a modular type and its capacity may be increased or reduced without great efforts. To increase the production capacity, only a new extrusion head 20 has to be attached. This can be carried out by adding the extrusion head 20 together with a deflector 21 and a collector 22 assigned to said extrusion head, as an extension unit 25 of the modular spinning system 1.

Thanks to the production of a substantially planar curtain and due to the deflection as a curtain, an extension is easily possible without any considerable impairment of the flow in the precipitation bath and without the need for further reconstruction measures. Moreover, a rapid and simple extension is possible and results in short standstill times only.

A second embodiment of the invention will now be described with reference to FIG. 2. Like reference numerals are used for components and parts which, in the embodiment of FIG. 2, have the same function or are of the same structure as the corresponding components and parts of the embodiment of FIG. 1.

Figure 2:
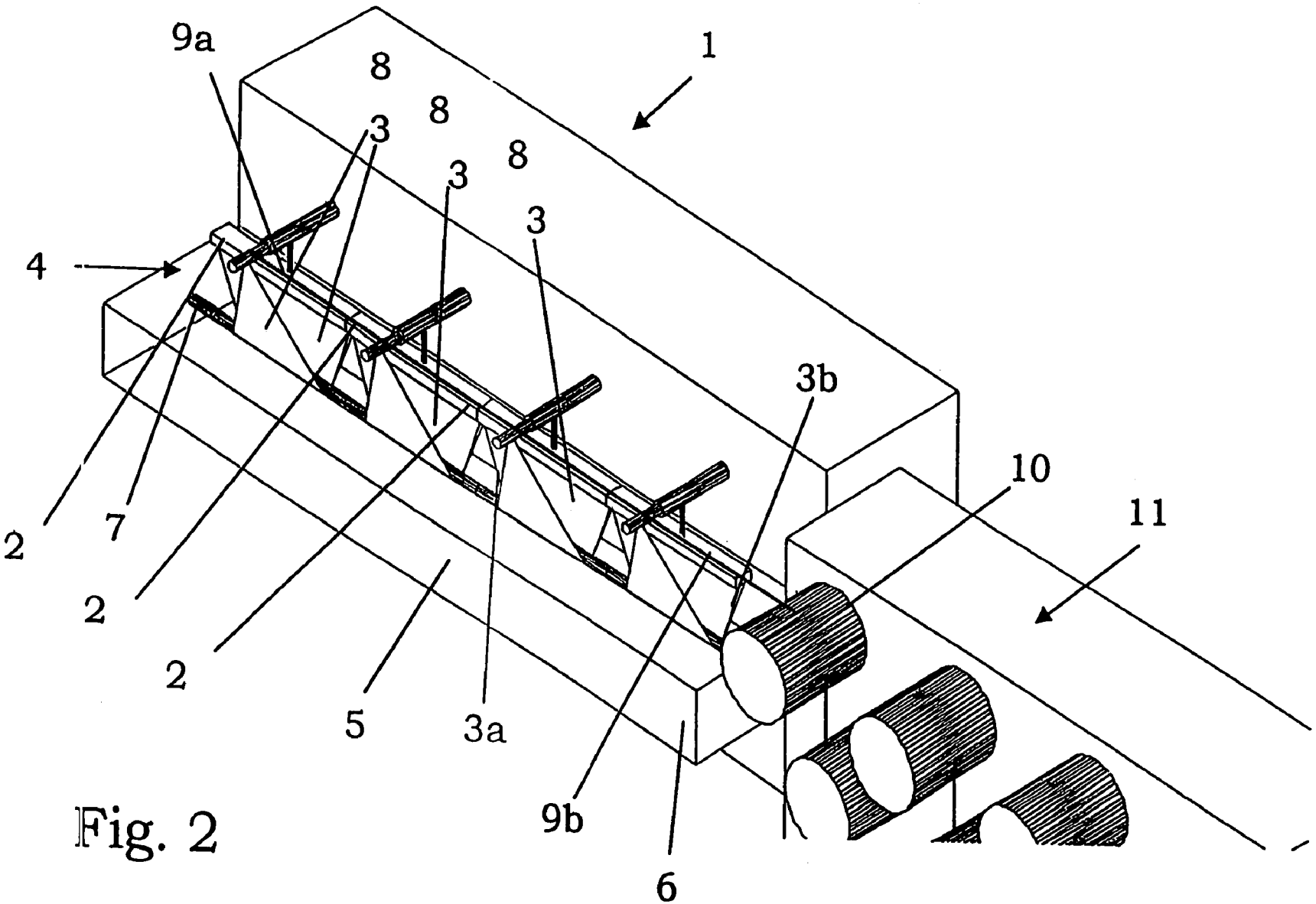
FIG. 2 shows a second embodiment of the invention, also in a schematic representation.

The spinning system of FIG. 2 substantially differs from the spinning system of FIG. 1 by the orientation of the extrusion heads 2 and by the design of the deflector 7.

In the embodiment of FIG. 2, the extrusion heads 2, unlike those in the embodiment of FIG. 1, are not arranged in parallel but are aligned in a row. The individual curtains 3 formed by th continuously molded bodies are now located side by side. One respective extrusion head 2 can form one or several curtains 3.

Accordingly, only one single deflector 7 is provided and extends in parallel with the extrusion heads 2. In the embodiment of FIG. 2, the continuously molded bodies are also only converged after the deflector 7 substantially towards one point and deflected as a curtain.

In the spinning system 1 of FIG. 2, the axes of the deflector 7 and of the collectors 8 are perpendicular to one another. The collectors 8 in the spinning system of FIG. 2 are identical with those of the spinning system of FIG. 1, i.e. each curtain 3 has assigned t hereto a collector which converges the curtain towards substantially one point and passes the same onwards as a bundle of continuously molded bodies. The bundles 9*a* of continuously molded bodies of all curtains are united by the collectors to obtain a single bundle 9*b*.

The spinning system of FIG. 2 can be extended in two ways: First of all, in parallel with the existing row of extrusion heads 2, it is possible to add a second, third, etc. row of extrusion heads 2*a* with a deflector 7*b* of their own. Depending on the length of the collectors 8 two respective curtains can then be united on one collector to obtain two respective bundles or on joint bundle.

The extrusion apparatus of FIG. 2 can then be extended by adding a further extrusion head 2 to the already existing row of extrusion heads and by attaching an extension to the deflector 7 and by a further collector 8. Like in the embodiment of FIG. 1, the extrusion head 2 can be equipped with the extension of the deflector and with the additional collector as an extension unit.

The invention claimed is:

1. A method for producing a continuously molded body from an extrusion solution, in particular an extrusion solution containing water, cellulose and tertiary amine oxide, the method comprising supplying the extrusion solution to a plurality of extrusion orifices substantially arranged in a row;

extruding the extrusion solution through a respective extrusion orifice to obtain a continuously molded body;

forming a substantially planar curtain of individual, continuously molded bodies, immersing the curtain into a precipitation bath; and deflecting the curtain in the precipitation bath by a deflector, converging the curtain of individual, continuously molded bodies toward substantially one point with at least one collector.

2. The method according to claim 1, further comprising simultaneously producing a multitude of curtains.

3. The method according to claim 2, further comprising simultaneously deflecting the multitude of curtains by at least one deflector.

4. The method according to claim 2, further comprising converging at least a partial amount of the multitude of curtains towards substantially one point for forming a fiber bundle.

5. The method according to claim 1, further comprising:

passing the extruded, continuously molded bodies through an air gap;

stretching the extruded, continuously molded body in the air gap.

6. The method according to claim 5, further comprising supplying a flow of air in the air gap either in the direction of extrusion or in a direction transverse to the direction of extrusion.

7. An apparatus for producing continuously molded bodies from an extrusion solution, in particular an extrusion solution containing water, cellulose and tertiary amine oxide, comprising an extrusion head including a multitude of extrusion orifices substantially arranged in row-like configuration, the extrusion solution being extrudable during operation through the respective extrusion orifices to obtain a continuously molded body, the extruded, continuously molded bodies forming a substantially planar curtain due to the arrangement of the extrusion orifices, and comprising a deflector arranged in a precipitation bath into which the continuously molded bodies are immersed, by which the curtain of the extruded, continuously molded bodies is deflected during operation, wherein the collector is positioned in the direction of extrusion downstream of the deflector, the curtain being converged by the collector substantially towards one point.

8. The apparatus according to claim 7, wherein the collector is arranged outside the precipitation bath.

9. The apparatus according to claim 7, wherein the apparatus comprises a multitude of extrusion heads out of each of which at least one curtain of continuously molded bodies exits during operation.

10. The apparatus according to claim 7, wherein the extrusion heads are substantially aligned in parallel with one another in the direction of the rows of the extrusion orifices.

11. The apparatus according to claim 10, wherein a plurality of curtains are formed by one extrusion head during operation.

12. The apparatus to according to claim 10, wherein a plurality of extrusion heads are preferably arranged in mutual alignment in series one behind the other.

13. The apparatus according to claim 7, wherein a multitude of curtains are deflected by the deflector.

14. The apparatus according to claim 7, wherein the deflector as a deflection roller is of a substantially circular cylindrical configuration.

15. The apparatus according to claim 14, wherein the axis of the deflection roller extends either substantially in parallel with or substantially in direction transverse to the direction of row of the extrusion orifices.

16. The apparatus according to claim 14, wherein the axes of the deflector and of the collector are arranged in vertically offset fashion.

17. The apparatus according to claim 7, wherein each curtain has assigned thereto a deflector.

18. The apparatus according to claim 7, wherein each deflector has assigned thereto a collector.

19. The apparatus according to claim 7, wherein the apparatus is of a modular structure and comprises receiving means into which at least one extrusion head and/or at least one deflector and/or at least one collector can detachably be inserted.

20. The apparatus according to claim 19, wherein for the extension of the apparatus at least one extrusion head and one deflector are combined to form an extension unit which is mountable on the apparatus.

* * * * *